US008943984B2

(12) United States Patent
Cheung

(10) Patent No.: US 8,943,984 B2
(45) Date of Patent: Feb. 3, 2015

(54) GIRDER BAND FOR UNDERWEAR CONNECTION AND PROCESSING METHOD THEREOF

(75) Inventor: Suilung Cheung, Guangdong (CN)

(73) Assignee: Kalping Leadtheway Hook & Eye Tape Ltd., Guangdong (CN)

( * ) Notice: Subject to any disclaimer, the term of this patent is extended or adjusted under 35 U.S.C. 154(b) by 781 days.

(21) Appl. No.: 13/237,906

(22) Filed: Sep. 20, 2011

(65) Prior Publication Data

US 2013/0068147 A1 Mar. 21, 2013

(51) Int. Cl.
*A41F 1/00* (2006.01)

(52) U.S. Cl.
CPC .. *A41F 1/00* (2013.01); *A41F 1/006* (2013.01)
USPC ..... 112/406

(58) Field of Classification Search
USPC ..... 112/406, 407, 418, 424, 105; 2/47, 48, 2/70, 96, 100, 119, 155
See application file for complete search history.

(56) References Cited

U.S. PATENT DOCUMENTS

| | | | | |
|---|---|---|---|---|
| 2,802,215 | A * | 8/1957 | Alfandre | 112/407 |
| 2,861,276 | A * | 11/1958 | Alfandre | 112/407 |
| 5,820,444 | A * | 10/1998 | McGaughey | 450/70 |
| 7,918,711 | B2 * | 4/2011 | Yeung | 450/58 |
| 7,922,682 | B2 * | 4/2011 | Bell et al. | 602/75 |

* cited by examiner

*Primary Examiner* — Tejash Patel

(57) ABSTRACT

A girdle band for underwear connection and a processing method thereof, the girder band has a baseband with upper and lower overturning edges, a plurality of snap rings, surface cloth and a shaping layer, and the processing method has the following steps: firstly respectively connecting both surfaces of the lower overturning edge of the baseband with the shaping layer and the first strip of the surface cloth; sewing the bottom surface of the second strip of the surface cloth with the shaping layer; forming the upper and the lower overturning edges; and using an ultrasonic wave cutting machine for cutting the long strip-shaped baseband into girdle band units. The girdle band has the advantages of no sewing joints on the back surface and good appearance effect, and can avoid skin injuries.

5 Claims, 4 Drawing Sheets

A-A

A-A

B-B

C-C

GIRDER BAND FOR UNDERWEAR CONNECTION AND PROCESSING METHOD THEREOF

BACKGROUND OF THE INVENTION

The invention relates to a connection fitting for connecting underwear back straps, in particular to a girder band arranged at one end of the underwear back strap and a processing method thereof.

An existing underwear connecting part is sewn at the end parts of two back straps, the underwear connecting part comprises snap rings and a hook belt, which are mutually matched, the connecting part comprises the front surface and the back surface, the front surface is the surface being close to clothes, the back surface is the surface being close to skin of a human body, and a row or a plurality of rows of the snap rings are arranged on the front surface; as for an existing girder band, the snap rings are directly sewn on a baseband during processing, rows of sewing joins are correspondingly left on the back surface (that is the surface being close to the skin of the girder band) of the baseband, thereby affecting aesthetics of underwear; furthermore, due to the existence of the sewing joints, the sewing joint-like tightening traces can correspondingly emerge on the back of a woman wearing the underwear, thereby affecting the mood of pursuing perfection of the woman; in addition, the sewing joints are uneven and can bring discomfort to a wearer due to long-term contact and friction with the skin.

BRIEF SUMMARY OF THE INVENTION

The invention aims at solving the above problems and providing a girder band which has no sewing joints on the back surface and good appearance effect, is comfort to wear and can avoid skin injuries and a processing method thereof.

The technical scheme adopted by the invention is as follows:

The girder band for underwear connection comprises a baseband and at least one snap ring arranged on the baseband, a compression snap ring is arranged on the upper layer of the snap rings and sewn on surface cloth on the baseband, the baseband comprises a base layer on the back surface, cloth material at two ends of the base layer extends and is folded to the front surface for forming upper and lower overturning edges, the overturning edges are in interaction with the surface cloth for sewing and positioning the snap rings, a shaping layer is arranged between the baseband and the surface cloth, the shaping layer is sewn and connected with the lower overturning edge positioned on the front surface and the surface cloth, the surface without the sewing joints is arranged on the outer surface of the base layer, and two sides of the base band are formed by cutting weld joints.

The further improvement of the invention is as follows: the snap rings on the baseband are arranged into two rows or more than two rows, the surface cloth for sewing the snap rings correspondingly comprises two pieces and more than two pieces of the surface cloth, the lower row of the snap rings are sewn and positioned with the lower overturning edge of the base layer by utilizing the surface cloth at the lower end, and the other rows of the snap rings except the lower row of the snap rings are respectively sewn, clamped and positioned through the adjacent two pieces of the surface cloth.

The processing method for manufacturing the girder band comprises the following steps:

(a) Respectively connecting both surfaces of the lower overturning edge of the baseband with the shaping layer and the first strip of the surface cloth by sewing, clamping and positioning the snap rings, and sewing the first row of the snap rings at the lower end;

(b) Taking the other side edge of the surface cloth producing the first row of the snap rings as a base material, connecting the base material with the second strip of the surface cloth by sewing, clamping and positioning the snap rings, simultaneously sewing the bottom surface of the second strip of the surface cloth with the shaping layer, sewing the second row of the snap rings, and sewing other rows of the snap rings in the same way;

(c) Overturning the baseband around the bottom, covering sewing joints on the bottom surface of the shaping layer, and extending and folding the cloth material at two ends of the base layer to the front surface of the shaping layer for forming the upper and the lower overturning edges;

(d) Using an ultrasonic wave cutting machine for cutting the baseband into girdle band units.

The further improvement of the technical scheme is that, in the step (c), an ultrasonic spot-welding machine is utilized to spot-weld and position the upper overturning edge so as to enable the upper overturning edge to be close to the shaping layer.

The further improvement of the technical scheme is that, the processed girdle band units are polished, and the polishing parts are the two cut side edges formed during cutting.

The girder band has the benefits that the bottom surface of the baseband is the surface without the sewing joints, and the manufactured girder band is aesthetic, beautiful and high in grade; as the bottom surface of the baseband has no sewing joints, the sewing joint-like tightening traces can be prevented from emerging on the back of a woman wearing underwear manufactured by adopting the girder band; simultaneously, as the bottom surface of the baseband is smooth, the discomfort can be avoided during the use.

In addition, the design further comprises the step of polishing the segmented girder band units, thereby further eliminating the sharp side edges emerged when performing ultrasonic cutting on the two side edges of the girder band, and enabling a user to be more comfortable to wear.

BRIEF DESCRIPTION OF THE DRAWINGS

In combination of the following figures and the embodiments, the invention is further described.

DETAILED DESCRIPTION OF THE INVENTION

Figure 1:
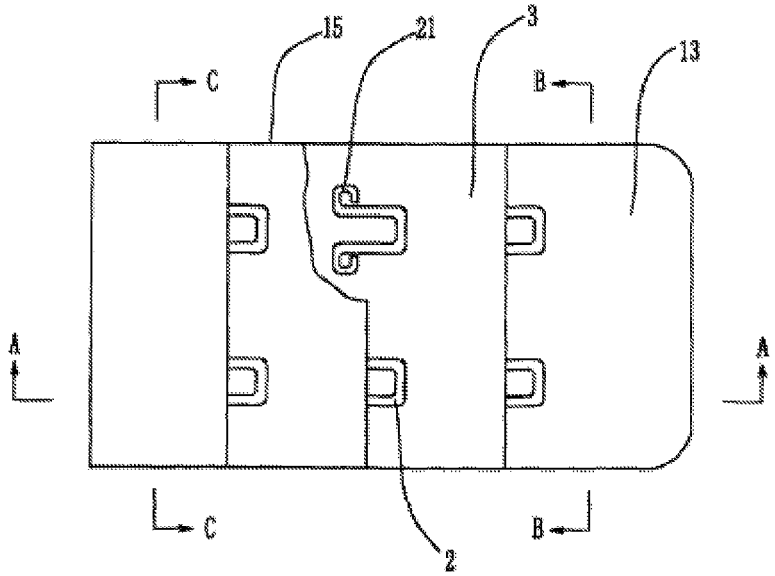
FIG. 1 is a schematic diagram of structure of the invention.
Figure 2:
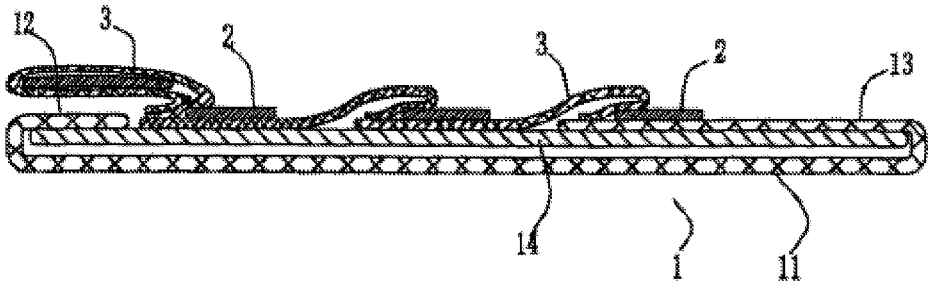
FIG. 2 is an A-A sectional view of FIG. 1.
Figure 3:
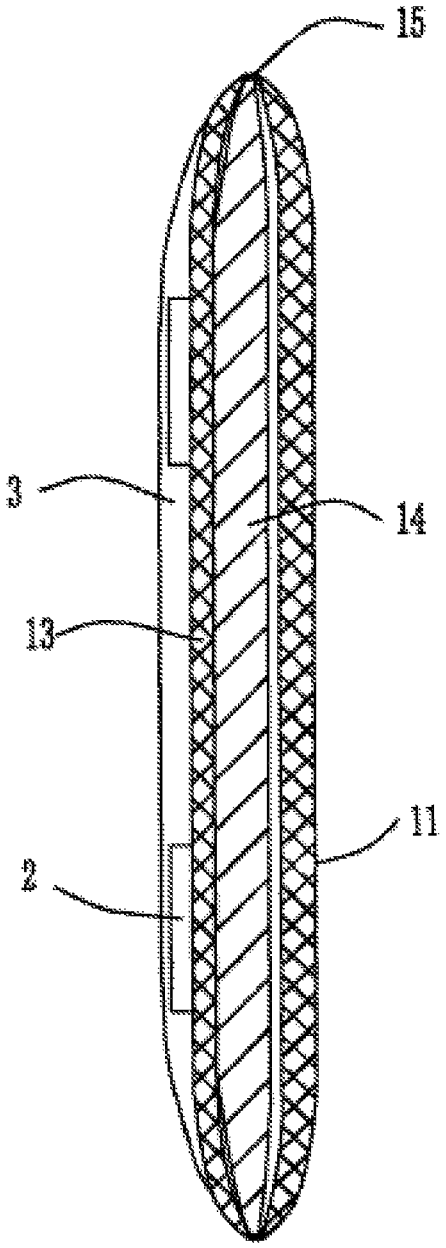
FIG. 3 is a B-B sectional view of FIG. 1.
Figure 4:
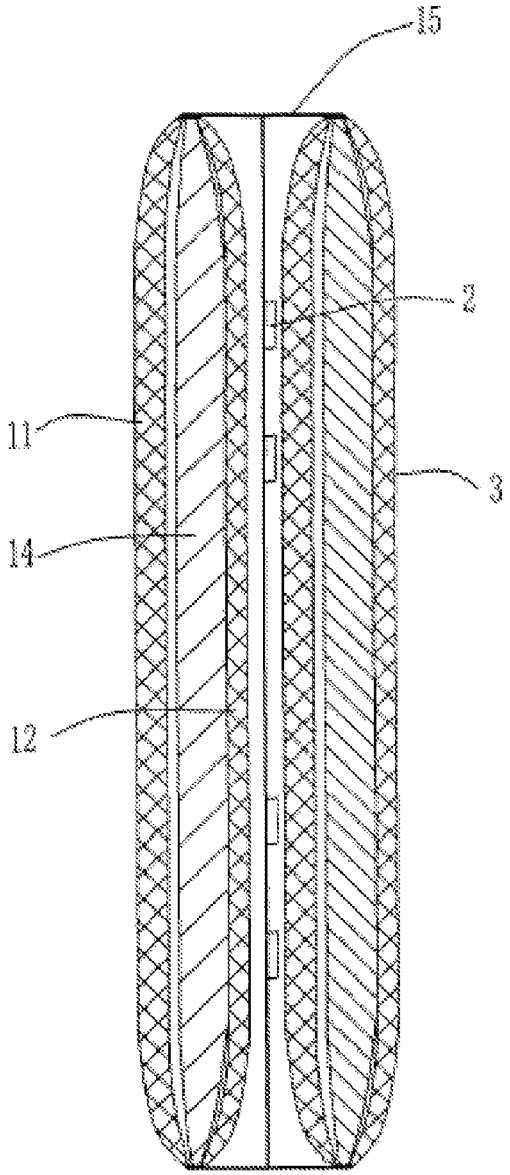
FIG. 4 is a C-C sectional view of FIG. 1.

Referring to FIG. 1 to FIG. 5, a girder band for underwear connection comprises a baseband 1 and at least one snap ring 2 arranged on the baseband 1, a compression snap ring is arranged on the upper layer of the snap rings 2 and sewn on surface cloth 3 on the baseband, the baseband 1 comprises a base layer 11 on the back surface, cloth material at two ends of the base layer 11 extends and is folded to the front surface for forming upper and lower overturning edges 12 and 13, the lower overturning edge 13 is in interaction with the surface cloth 3 for sewing and positioning the snap rings 2, a shaping layer 14 is arranged in the baseband 1, the shaping layer 14 is connected with the upper and the lower overturning edges 12 and 13 positioned on the front surface and the surface cloth 3, the outer surface of a base layer 11 is the surface without sewing joints, and two sides of the base band 1 are cut and fused edges 15.

Further, the snap rings 2 on the baseband 1 are arranged into two rows or more than two rows, the surface cloth 3 for sewing the snap rings correspondingly comprises two pieces and more than two pieces of the surface cloth, the lower row of the snap rings are sewn and positioned with the lower overturning edge of the base layer by utilizing the surface cloth at the lower end, and the other rows of the snap rings except the lower row of the snap rings are respectively sewn, clamped and positioned through the adjacent two pieces of the surface cloth, and a product with the multiple rows of the snap rings is more applicable to the needs of most of consumers.

Figure 5:
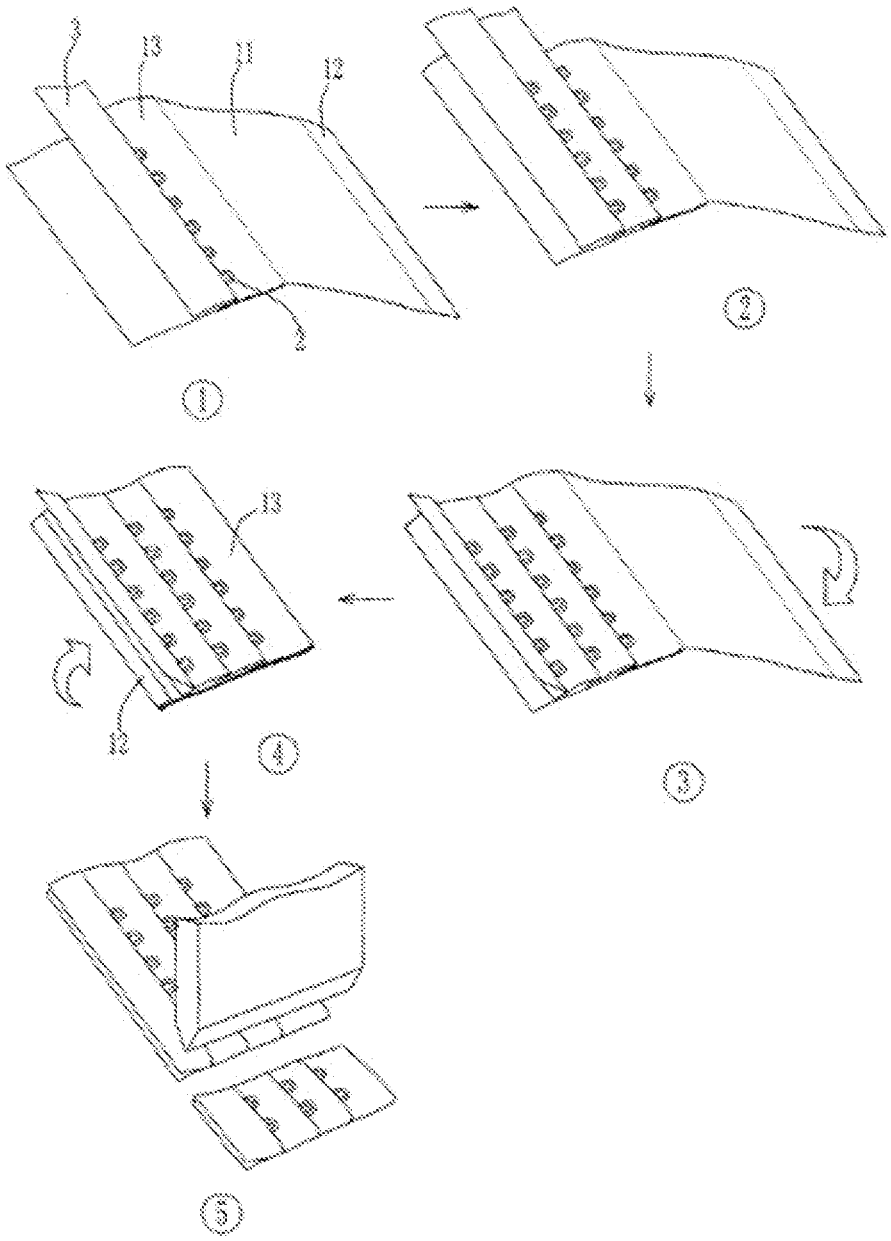
FIG. 5 is a brief processing flow chart of the invention.

A processing method for manufacturing the girder band comprises the following steps: firstly taking expanded long cloth material as a baseband, taking one edge of the baseband as a lower overturning edge, respectively connecting both surfaces of the lower overturning edge with the shaping layer and the first strip of the surface cloth by sewing, simultaneously fixing snap ring pins 21 of the snap rings 2 so as to clamp and position the snap rings, and sewing the first row of the snap rings at the lower end (referring to process step (1) in FIG. 5); taking the other side edge of the surface cloth producing the first row of the snap rings as a base material, connecting the base material with the second strip of the surface cloth by sewing, clamping and positioning the snap rings, simultaneously sewing the bottom surface of the second strip of the surface cloth with the shaping layer, sewing the second row of the snap rings, and sewing other rows of the snap rings in the same way (referring to the process steps (2) and (3) in FIG. 5); overturning the baseband around the bottom, namely wrapping the shaping layer by utilizing space formed by the base layer, the upper overturning edge and the lower overturning edge, and further covering the sewing joints on the bottom surface of the shaping layer (referring to the process step (4) in FIG. 5); using an ultrasonic spot-welding machine to spot-weld and position the upper overturning edge after the cloth material at the upper end of the base layer extends and is folded to the front surface of the shaping layer for forming the upper overturning edge so as to facilitate the positioning of the upper overturning edge after overturning and enable the upper overturning edge to be close the shaping layer, wherein the edge pressing and positioning way can also be adopted in addition to the spot-welding positioning way; and finally using an ultrasonic wave cutting machine for cutting the baseband into girdle band units (referring to the process step (5) in FIG. 5).

As the ultrasonic device is used during cutting, the cloth material at the top layer and the bottom layer of a back buckle can be fused and sealed under the action of pressure of a cutting knife edge and ultrasonic waves, the process can result in emergence of harder sharp side edges in the segmentation positions, which may bring discomfort to a wearer, the design further performs improvement against the problem, the two cut side edges of the processed girder band units are polished so as to eliminate the sharp side edges.

The girder band for underwear connection and the processing method thereof can eliminate the sewing joins which can emerge on the bottom surface of the baseband during the processing in the past and enable the manufactured girder band to be more aesthetic and beautiful; simultaneously, as the bottom surface of the baseband has no sewing joints, the sewing joint-like tightening traces can be prevented from emerging on the back of a woman wearing underwear manufactured by adopting the girder band; in addition, as the bottom surface of the baseband is smooth, the discomfort can be avoided during the use.

The above embodiments are only the preferential embodiments of the invention and do not limit the protection range of the invention, and the ones adopting the basically identical means to achieve the purposes of the invention shall belong to the protection range of the invention.

What is claimed is:

1. A girder band for underwear connection comprising a baseband (1) and at least one snap ring (2) arranged on the baseband (1), wherein a compression snap ring is arranged on an upper layer of snap rings and sewn on a surface cloth (3) on the baseband (1); the girder band is characterized in that the baseband (1) comprises a base layer (11) on a back surface of the baseband (1), cloth material at two ends of the base layer (11) extends and is folded to a front surface of the baseband (1) for forming upper and lower overturning edges (12) and (13), the lower overturning edge (13) is in interaction with the surface cloth (3) for sewing and positioning the snap rings, a shaping layer (14) is arranged in the baseband (1), one end of a front surface of the shaping layer (14) is connected with the upper overturning edge (12) and another end of the front surface of the shaping layer (14) is connected with the lower overturning edge (13) positioned on the front surface and the surface cloth (3), an outer surface of the base layer (11) is the surface without sewing joints, and two sides of the base band (1) are cut and fused edges (15).

2. The girder band for underwear connection according to claim 1, characterized in that the snap rings on the baseband (1) are arranged into two rows or more than two rows, the surface cloth (3) for sewing the snap rings correspondingly comprises two pieces and more than two pieces, a lower row of the snap rings are sewn and positioned with the lower overturning edge of the base layer (11) by utilizing the surface cloth (3) at a lower end, and other rows of the snap rings except the lower row of the snap rings are respectively sewn, clamped and positioned through adjacent two pieces of the surface cloth (3).

3. A processing method of the girder band for underwear connection according to claim 2, wherein the processing method comprises the following steps:

(a) connecting both surfaces of a lower overturning edge (13) of a baseband (1) with one end of a front surface of a shaping layer (14) and a first strip of a surface cloth (3) by sewing respectively; clamping and positioning snap rings, and sewing a first row of the snap rings at a lower end;

(b) taking another side edge of the surface cloth (3) producing the first row of the snap rings as a base material; connecting the base material with a second strip of the surface cloth (3) by sewing; clamping and positioning the snap rings, simultaneously sewing a bottom surface of the second strip of the surface cloth (3) with the shaping layer (14); sewing a second row of the snap rings; repeating step (b) to sew other rows of the snap rings;

(c) overturning the baseband (1) around its bottom; covering swing joints on a bottom surface of the shaping layer (14), and extending and folding cloth material at two ends of the base layer (11) to the front surface of the shaping layer (14) for forming an upper overturning edge (12) and the lower overturning (13) with the one end of the front surface of the shaping layer (14) connected with the upper overturning edge (12) and another end of the front surface of the shaping layer (14) connected with the lower overturning edge (13);

(d) using an ultrasonic wave cutting machine for cutting the baseband (1) into girdle band units.

4. The processing method according to claim 3, characterized in that, in step (c), an ultrasonic spot-welding machine is utilized to spot-weld and position the upper overturning edge (13) so as to enable the upper overturning edge (13) to be close to the shaping layer (14).

5. The processing method according to claim 3, characterized in that the girdle band units are polished, and parts of the girdle band units being polished are two cut side edges formed during cutting.

* * * * *